United States Patent [19]

Zlobin et al.

[11] Patent Number: 5,066,389

[45] Date of Patent: Nov. 19, 1991

[54] FLOTATION MACHINE

[76] Inventors: Mikhail N. Zlobin, ulitsa Pavlova, 12, kv. 1, Mirny; Viktor M. Metsik, Uuitsa Dekabraskikh sobyty, 86, kv. 32; Alexandr A. Nemarov, mikroraion Jubileiny, 91, kv. 36, both of Irkutsk; Georgy P. Permyakov, ulitsa 50 let Oktyabrya, 7, kv. 37; Nikolai T. Taraban, ulitsa Sovetskara, 15, korpus 2, kv. 15, both of Mirny, all of U.S.S.R.

[21] Appl. No.: 589,394

[22] Filed: Sep. 27, 1990

[51] Int. Cl.[5] ..... B03D 1/24

[52] U.S. Cl. ..... 209/170; 209/168; 261/79.2; 261/DIG. 48

[58] Field of Search ..... 209/168, 169, 170; 210/221.2; 261/123, 124, 79.2, DIG. 48

[56] References Cited

FOREIGN PATENT DOCUMENTS

| | | | |
|---|---|---|---|
| 749436 | 7/1980 | U.S.S.R. | 209/170 |
| 948498 | 12/1982 | U.S.S.R. | 209/170 |
| 1093357 | 5/1984 | U.S.S.R. | 209/170 |
| 1183180 | 10/1985 | U.S.S.R. | 209/170 |
| 1233947 | 5/1986 | U.S.S.R. | 209/170 |

*Primary Examiner*—Stanley S. Silverman
*Assistant Examiner*—Thomas M. Lithgow
*Attorney, Agent, or Firm*—Burgess, Ryan & Wayne

[57] ABSTRACT

A flotation machine comprises a cylindrical chamber having a tapered bottom to which there are secured a pipe for feeding a flotation pulp containing mineral particles of fine fraction, and a pipe for discharging gangue. Secured at the walls of the chamber is a trough for collecting froth concentrate and a group of pulp aerators, whereas arranged axially inside the chamber is a group of tapered shells spaced equidistantly heightwise of the chamber, bases of larger diameter of these shells facing the top part of the chamber and resting in one tapered surface, and one more group of tapered shells arranged at the top part of the chamber outside the shells of the first group, bases of smaller diameter of the shells facing the bottom and resting in one tapered surface outside the tapered shells of this group. Overlying the chamber is a means for feeding mineral particles of coarse fraction.

8 Claims, 3 Drawing Sheets

FLOTATION MACHINE

FIELD OF THE INVENTION

This invention relates generally to processing minerals, particularly to arrangements for beneficiating minerals by flotation of solid particles of useful ingredient of the mineral and, more particularly, to a flotation machine.

The proposed flotation machine can be used with success for beneficiating virtually all types of mineral materials in which the useful ingredients are finely disseminated in the mineral. Such minerals include ores of ferrous, non-ferrous and rare metals, non-metallic minerals, coal and diamond-containing minerals.

BACKGROUND OF THE INVENTION

When beneficiating minerals by flotation, it is necessary that this mineral be preliminarily comminuted to the size of solids allowing to carry out the process of flotation. The optimum size of solids of the useful ingredient capable of floating up from the volume of the flotation pulp is different for each type of mineral, and depends largely on the density of the useful ingredient in such a mineral.

For example, with regards to an ore mineral beneficiated by widely known flotation machines, the average size of solids normally ranges from 0.01 to 0.1 mm. For a diamond-containing mineral, the optimum size of particles capable of floating up from the body of the flotation pulp is not more than 0.5 mm.

Reducing a mineral to the optimum particle size is accompanied by excessive comminution of the useful ingredient disseminated in the mineral to a size which is more than the upper limit of floatability, or to a size which is close to the optimum. As is known, reduction in the size of solid particles of the useful ingredient affects the value of such a useful ingredient. Such a loss of value is especially pronounced when overcomminuting a diamond-containing mineral.

It is also to be noted that the greater part of the overall expenditures associated with beneficiation of minerals falls on comminution, and is as large as 40% of all expenditures for processing the mineral.

Therefore, it is especially important to increase the upper limit of the size of mineral particles subjected to processing in a flotation machine. The accompanying advantage is an increase in the efficiency of the equipment for comminuting minerals. For example, an increase in the upper limit of particle size results in a 30% growth in the efficiency of ball mills. In some instances a higher grain size concentrates are more amenable to subsequent processing. Large diamond crystals have a higher value than small ones.

There is known a flotation machine (cf., SU, A, 984,498) comprising a vertical cylindrical chamber for circulating a flotation pulp having a tapered bottom and accommodating at the top part thereof a trough for collecting froth concentrate, and a pipe for continuously feeding the flotation pulp positioned axially of the chamber. Disposed coaxially inside the chamber is a hollow cone member with the top of the cone facing the bottom of the chamber, this cone member having slotted holes to distribute uniformly the pulp in the volume of the chamber. The slotted holes are spaced at equal distances from one another in terms of the height of the cone, inclined to the axis of the cone at an acute angle, and directed toward the upper end of the chamber.

The bottom part of the chamber accommodates pulp aerators in the form of perforated rubber tubes, and a pipe for discharging gangue.

The top size limit of particles of the useful ingredient of the mineral capable of floating up from the body of aerated pulp with respect to a diamond-containing mineral is not more than 1 mm. In other words, the maximum size of solid particles of the useful ingredient in a froth concentrate produced in this flotation machine is not more than 1 mm.

There is also known a flotation machine capable of doubling the size of solids in a froth concentrate (cf., SU, A, 1,183,180).

This flotation machine includes a vertical cylindrical chamber to circulate a flotation pulp having a tapered bottom to which there are secured a pipe for feeding the flotation pulp containing mineral particles of fine fraction and a pipe for discharging gangue, an annular trough for collecting froth concentrate attached to the walls of the pulp circulation chamber in its top portion, a group of tapered shells secured axially inside the pulp circulation chamber and spaced at equal distances from one another in terms of the height of the chamber, the height and inclination angles of the generating lines of the tapered surfaces thereof to their axes of rotation being substantially equal, bases of larger diameter of the shells facing the top of the chamber and resting in one tapered surface outside the tapered shells, the inclination angle of the generating line of this common tapered surface to its own axis of rotation being smaller than the inclination angle of the generating lines of the tapered surfaces of the shells, at least one group of pulp aerators having tubular casings thereof secured at the walls of the pulp circulation chamber and spaced equidistantly about the circumference, and a means for feeding mineral particles of coarse fraction positioned over the pulp circulation chamber.

Provision of this means for feeding mineral solids of coarse fraction to the froth layer makes it possible to obtain a froth concentrate containing solid particles of a diamond-containing mineral up to 2 mm across, as the froth layer of the pulp is capable of reliably holding solids of the useful ingredient of the mineral of a size at least twice the size of solid particles of the useful ingredient of the mineral capable of floating up from the body of the aerated pulp.

However, this flotation machine suffers from losses of quite large solids of the useful ingredient which can fall out of the froth layer as it moves axially of the chamber toward the froth collecting trough. Because the size of these solid particles of the useful ingredient of the mineral entering the annular clearance between the tapered shells and walls of the cylindrical pulp circulation chamber exceeds the upper size limit of particles capable of floating up from the volume of the aerated pulp, such particles are irretrievably lost when entrained by the gangue. Return to the froth layer of particles of useful ingredient of the mineral sizing close to the upper size limit of solids capable of floating up from the body of the aerated pulp and entering this clearance is very unlikely, since the vectors of velocity of air bubbles and mineral solids are directed to the opposite sides to result in a smaller tendency of air bubbles to adhere to the surface of the solid particles of the useful ingredient of the mineral.

In this prior art flotation machine for beneficiating minerals irretrievable losses of the particles of useful ingredient of the mineral sizing close to the upper size limit when such particles are still capable of floating up from the body of the aerated pulp bring down the yield of the useful ingredient from the mineral. This results in reduced percentage of large-size particles in the froth concentrate affecting the froth concentrate obtained in the course of beneficiation of a diamond-containing mineral.

SUMMARY OF THE INVENTION

It is an object of the present invention to increase the yield of the useful ingredient of the mineral subjected to beneficiation in a flotation machine.

The object is attained by that in a flotation machine for beneficiating minerals comprising a vertical cylindrical chamber for circulating a flotation pulp with a tapered bottom to which there are secured a pipe for feeding the flotation pulp containing mineral particles of fine fraction and a pipe for discharging gangue, an annular trough for collecting froth concentrate secured at the walls of the froth circulation chamber at its top portion, a group of tapered shells positioned axially in the pulp circulation chamber and spaced at equal distances from one another heightwise of the pulp circulation chamber, the height and inclination angles of the generating lines of the tapered surfaces of these tapered shells to their axes of rotation being substantially equal, bases of larger diameter of these shells facing the top part of this chamber and resting substantially at one tapered surface outside the tapered shells, the inclination angle of the generating line of this tapered surface to its axis of rotation being smaller than the inclination angle of the generating lines of the tapered surfaces of the shells, at least one group of pulp aerators whose tubular casings are secured at the walls of the pulp circulation chamber and are spaced equidistantly about the circumference, and a means for feeding mineral particles of coarse fraction positioned over the pulp circulation chamber, according to the invention, the flotation machine includes an additional group of tapered shells secured outside the tapered shells of the main group of shells at the top of the pulp circulation chamber in line with its axis, the height and inclination angles of the tapered surfaces thereof to their axes of rotation being substantially equal, whereas bases of smaller diameter of such shells face the bottom of the pulp circulation chamber and rest in one tapered surface outside the tapered shells of the additional group of shells, the inclination angle of the generating line of this tapered surface to its axis of rotation is greater than the inclination angle of the generating lines of the tapered surface of the shells of the additional group of shells to their axes of rotation.

It is preferable that in the proposed flotation machine for beneficiating minerals in the presence of at least two groups of pulp aerators positioned at different levels of the pulp circulation chamber axes of the tubular casings of the group of pulp aerators of the upper level be substantially perpendicular to the axis of the cylindrical pulp circulation chamber and lie in a plane immediately under the lower tapered shell of the additional group of shells, whereas the axes of tubular casings of the group of pulp aerators of the lower level be at an acute angle to the axis of the cylindrical pulp circulation chamber to be directed toward the tapered bottom of the chamber, each group of pulp aerators of the upper and lower levels preferably including an even number of pulp aerators.

In order to ensure a more uniform distribution of mineral particles at the surface of the froth layer, it is advantageous that a distribution ring be provided between the means for feeding mineral particles of coarse fraction and upper tapered shell of the additional group of shells coaxially with the tapered shells, the periphery of this ring having the form of radially extending teeth with teeth tops, if projected on a horizontal plane, disposed projections on this horizontal plane of the bases of larger diameter of the upper tapered shells of the main and additional groups of shells.

It is also desirable that each pulp aerator of the groups of aerators of the upper and lower levels be provided with three inserts having axial holes for generating acoustic vibrations positioned in succession in the tubular casing, one of the inserts at the side of a nozzle for feeding the liquid having tangential holes communicating its axial hole via an annular groove made in the tubular casing with a nozzle for feeding compressed air.

In view of the aforedescribed, the proposed flotation machine for beneficiating minerals is capable of retrieving 98-99% of the useful ingredient of minerals. The share of sufficiently large solid particles of the useful ingredient of the mineral sizing between 0.8 and 1.5 mm across is normally more than 50%.

Provision of an additional groups of tapered shells ensures return to the bottom pulp layer of the useful ingredient of the mineral of particle size approaching the upper size limit which can float up from the volume of aerated pulp and can incidentally, such as after colliding with other solids, separate from the layer of froth. These particles roll on the inner surface of the tapered shells of the additional group of shells, and then are stopped and entrained by air bubbles conveyed by the pulp aerators to the clearance between the tapered shells of the additional and main groups of shells.

Positioning the tubular casings of pulp aerators at different levels of the chamber affords more uniform distribution of air bubbles in the body of the flotation pulp occupying the pulp circulation chamber. Positioning the axes of the tubular pulp aerators of the upper level of aerators in a plane perpendicular to the axis of the chamber immediately under the lower tapered shell of the additional group of shells makes it possible to optimize the delivery of flows of the aerated liquid to the clearance between the tapered shells of the main and additional groups of shells, thereby increasing the likelihood of the mineral particles joining the air bubbles is very high.

The toothed distribution ring arranged between the means for feeding mineral particles of coarse fraction and upper tapered shells allows a more uniform spread of the particles at the surface of the froth layer of the pulp, reducing susceptibility of the particles to collisions and separation of the particles from the froth layer.

The proposed construction of pulp aerators provides a directional flow of the aerated liquid accompanied by uniform distribution of monodispersed air bubbles in this flow.

BRIEF DESCRIPTION OF THE DRAWINGS

The invention will now be described in greater detail with reference to various specific embodiments thereof taken in conjunction with the accompanying drawings, in which.

DETAILED DESCRIPTION OF THE INVENTION

Figure 1:
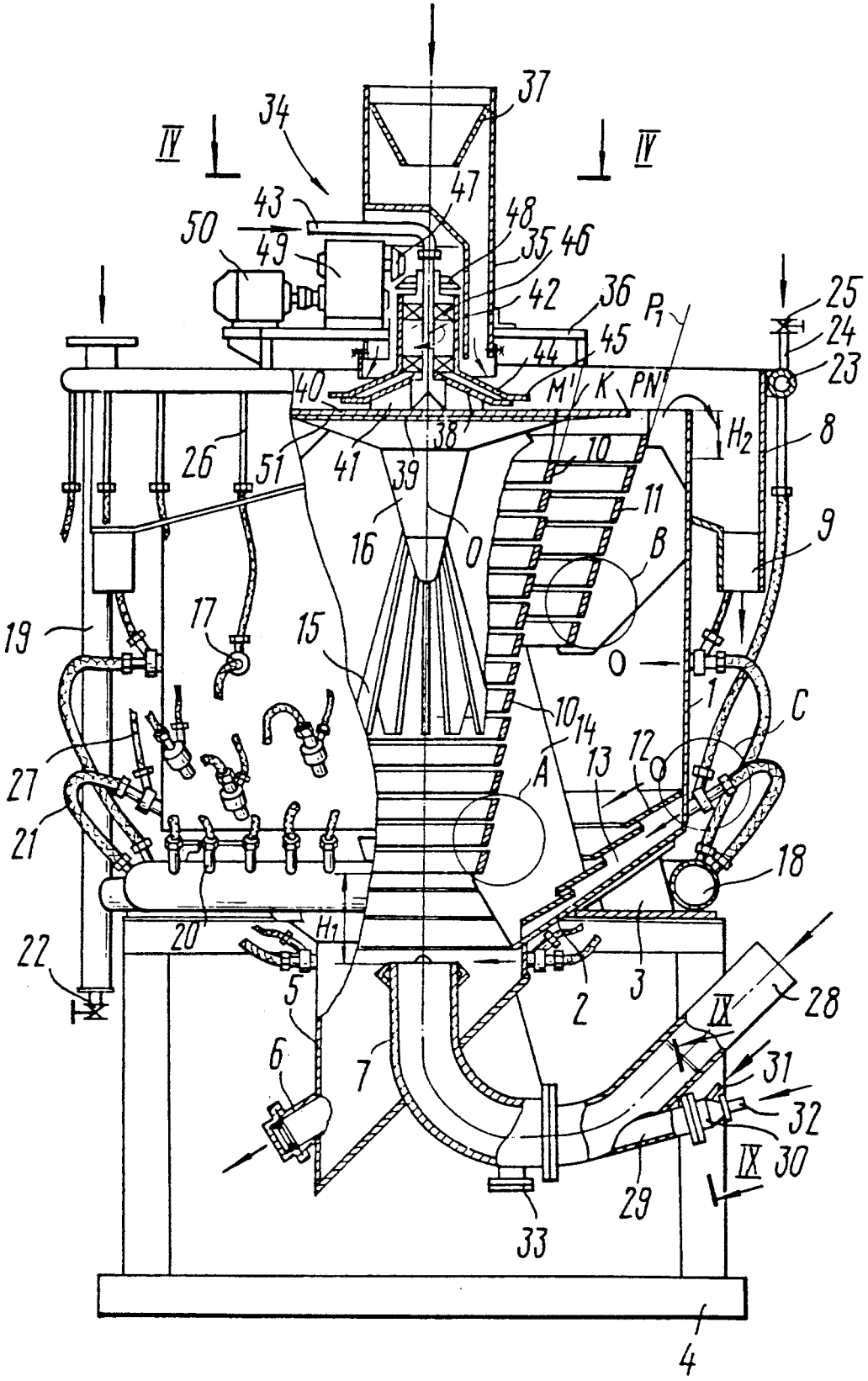
FIG. 1 is a partially longitudinal sectional view of a flotation machine, according to the invention.

A flotation machine for beneficiating minerals comprises a cylindrical chamber 1 (FIG. 1) for circulating a flotation pulp. The cylindrical chamber 1 has a tapered bottom 2 and is positioned vertically on bearing elements 3 rigidly connected, such as by welding, to a frame 4.

Connected to the tapered bottom 2 is a vessel 5 for collecting gangue on which there is secured a pipe 6 for discharging the gangue.

Provided at the bottom part of the chamber 1 for circulating the flotation pulp in line with its axis 0 is a pipe 7 for feeding the flotation pulp carrying mineral particles of the fine fraction. The outlet hole of the pipe 7 rests in line with the axis 0 of the pulp circulation chamber.

As is known, the size of solid particles carried by the flotation pulp depends on the density of the useful ingredient of the mineral being beneficiated, and the upper size limit of solids being floated is different for each specific type of mineral.

It is also known that the composition of flotation reagents of the pulp and their percentage varies with respect to each type of mineral.

For a diamond-containing mineral, the size of solid particles in flotation pulps of known compositions is usually 0.1 to 1 mm.

The flotation machine also includes a trough 8 for collecting froth concentrate positioned at the top of the pulp circulation chamber 1, the froth concentrate tending to overflow from the chamber 1 by gravity. The trough 8 for collecting froth concentrate is defined by the top part of the outer surface of the chamber 1 and a cylindrical shell disposed outside the chamber 1 coaxially therewith. The bottom of the trough 8 is inclined, and has pipes 9 for evacuating the froth concentrate.

Two groups of tapered shells 10, 11 are provided inside the cylindrical chamber 1. The tapered shells 10 of one such group, in the embodiment herein described fifteen such shells, are positioned axially of the chamber 1 and spaced equidistantly in terms of the height of the chamber 1.

The tapered shells 11 of the other group, in the embodiment described herein seven such shells, are positioned outside the tapered shells 10 of the first group at the top of the cylindrical chamber 1 to occupy the top half of this chamber 1.

In the modification of the proposed flotation machine represented in FIG. 1, the chamber 1 for circulating the flotation pulp accommodates one more group of four tapered shells 12 positioned in the immediate proximity to the tapered bottom 2. The inclination angle of the generating lines of the tapered surfaces of these shells 12 to their axes of rotation is substantially equal to the inclination angle of the generating line of the tapered surface of the botton 2.

The tapered shells 12 are somewhat spaced from each other, and the adjacent shells partially overlap each other.

The tapered shells 12 bear on ribs 13 secured at the tapered bottom 2.

Nine lower tapered shells 10 are secured at ribs 14 positioned in the chamber 1 outside the tapered shells 10, these ribs bearing on the tapered shells 12 and resting substantially in one plane with the ribs 13. The other six tapered shells are secured at ribs 15 inside the tapered shells 10, these ribs 15 bearing on four lower tapered shells 10 attached to the ribs 14.

Positioned in line with the axis 0 of the chamber 1 inside the tapered shells 10 is a tapered baffle element 16 connected rigidly, such as by welding, to the ribs 15.

Figure 2:
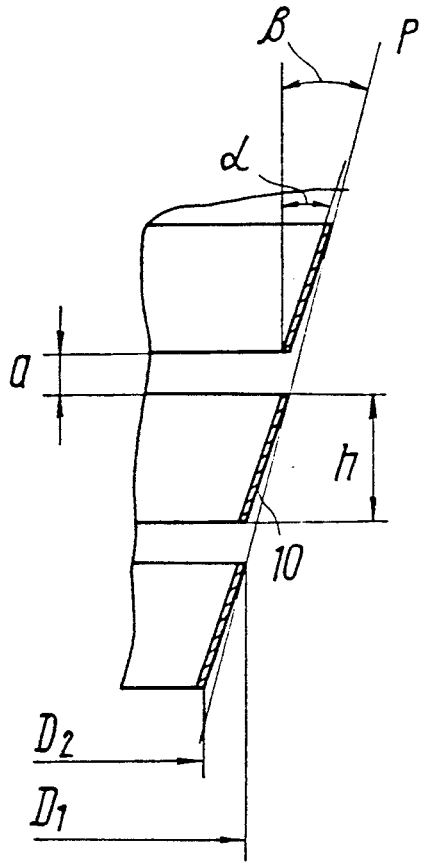
FIG. 2 is an enlarged view of section A in FIG. 1.

The tapered shells 10 have the same height h (FIG. 2) and equal inclination angles $\alpha$ of the generating lines of the tapered surfaces to their axes of rotation. The height h of the tapered shells 10 can range from 100 to 150 mm. The distance "a" between the tapered shells 10 depends on the size of the mineral solids, and is usually 3 to 10d, where d is the average diameter of mineral solids of fine fraction.

The tapered shells 10 face by their bases of larger diameter $D_1$ toward the top part of the cylindrical chamber 1 (FIG. 1), whereas their base of smaller diameter $D_2$ (FIG. 2) faces the tapered bottom 2 (FIG. 1). The diameters $D_1$ (FIG. 2) and $D_2$ of the bases of the tapered shells 10 grow from the bottom to the top shell 10, and the bases of larger diameter $D_1$ rest substantially at one tapered surface P outside the tapered shells 10, the inclination angle $\beta$ of the generating line of this surface P to its own axis of rotation being smaller than the inclination angle $\alpha$ of the generating lines of the tapered surfaces of the shells 10 to their axes of rotation. The angle $\alpha$ is 15° to 30°, whereas the angle $\beta$ is smaller than the angle $\alpha$ by a magnitude of 5° to 10°. In two adjacent tapered shells 10, the diameter $D_1$ of the larger base of the underlying shell 10 is greater than the diameter $D_2$ of the smaller base of the overlying shell 10. The diameter $D_2$ of the smaller base of the underlying tapered shell 10 is 1.5 to 2 diameters of the pipe 7 (FIG. 1) for feeding the flotation pulp. Provided between the lower tapered shell 10 and pipe 7 for feeding the flotation pulp is a clearance $H_1$ amounting to between 0.7 and 1.0 $D_2$ of the diameter of the smaller base of the lower shell 10.

Also provided between the upper tapered shell 10 and upper edge of the chamber 1 is a clearance $H_2$ of 200 to 300 mm, which ensures reduction in the turbulence of the flows of the top layers of the flotation pulp.

Figure 3:
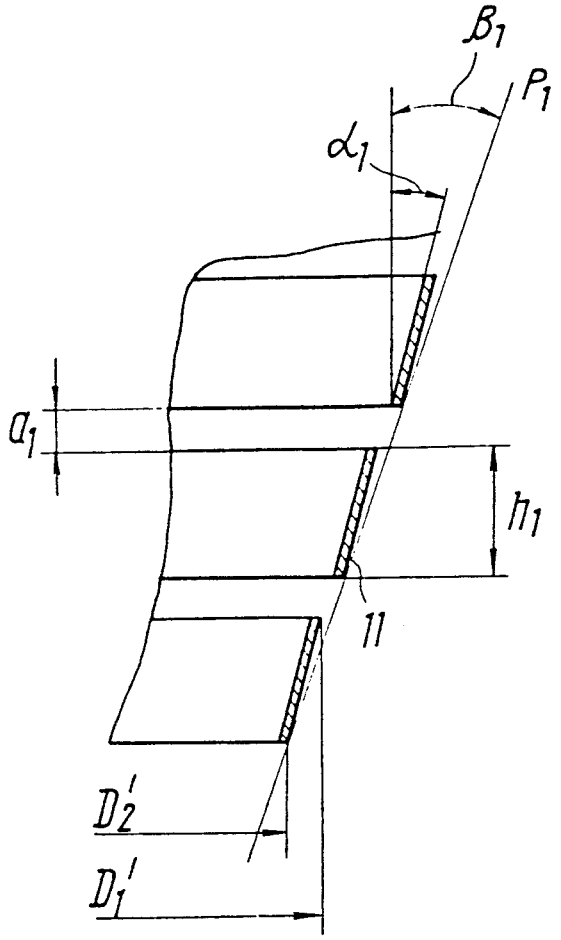
FIG. 3 is an enlarged view of section B in FIG. 1.

The tapered shells 11 of the other group of shells have the same height $h_1$ (FIG. 3) and equal inclination angles $\alpha_1$ of the generating lines of their tapered surfaces to the axes of rotation. The height $h_1$ of the tapered shells 11, as well as the height h (FIG. 2) of the tapered shells 10 can be 100 to 150 mm. The distance $a_1$ (FIG. 3) between the tapered shells 11 of this group is preferably 3d to 10d, where d is the average diameter of mineral particles of the fine fraction.

The bases of larger diameter $D'_1$ of the tapered shells 11 face the top part of the cylindrical chamber 1 (FIG. 1), whereas the bases of smaller diameter $D'_2$ (FIG. 3) face the tapered bottom 2 (FIG. 1). The diameters $D'_1$ (FIG. 3) and $D'_2$ of the bases of the tapered shells 11 grow from the lower to the upper tapered shell 11. The bases of smaller diameter $D'_1$ rest at one tapered surface $P_1$ outside the tapered shells 11, whereas the inclination angle $\beta_1$ of its generating line to its axis of rotation is greater than the inclination angle $\alpha_1$ of the generating lines of the tapered shells 11 to their axes of rotation.

The angle $\alpha_1$ is preselected depending on the angle of repose of the gangue in an aqueous medium, and is generally greater than this angle by 5°-20°. Normally, the angle $\beta_1$ is 5° to 10° greater than the angle $\alpha_1$.

In any two adjacent tapered shells 11, the diameter $D'_1$ of larger base of the underlying shell 11 is smaller than the diameter $D'_2$ of the smaller base of the overlying shell 11.

The flotation machine also includes at least one group of aerators 17 (FIG. 1) for aerating the flotation pulp, tubular casings of these aerators being secured at the walls of the cylindrical chamber 1 and equidistantly spaced about the circumference. The number of such groups of aerators 17 can be different, depending generally on the dimensions of the pulp circulation chamber 1. Preferably, the aerators are positioned so that air bubbles be uniformly distributed across the flotation pulp.

In the modification herein described, the flotation machine comprises four groups of pulp aerators 17 positioned at different levels heightwise of the pulp circulation chamber 1. All the pulp aerators 17 are similar in construction and intended to provide a flow of aerated liquid travelling axially of the tubular casing of the pulp aerator 17. Axes of the tubular casings of the pulp aerators 17 of the group of aerators of upper level are positioned substantially perpendicularly to the axis 0 of the cylindrical pulp circulation chamber 1 and rest in a plane immediately under the lower tapered shell 11. Axes of the tubular casings of the two groups of pulp aerators 17 of the lower level are positioned at an acute angle to the axis 0 of the cylindrical chamber 1 and are directed toward the tapered bottom of the chamber 1. This angle is substantially equal to the inclination angle of the generating line of the tapered bottom 2 of the chamber 1 to its own axis of rotation.

The number of pulp aerators 17 in each group of aerators is preferably even. In each of three groups of pulp aerators 17 secured at the cylindrical walls of the chamber 1, the number of aerators is eight, the pulp aerators 17 of the adjacent groups being arranged in a staggered manner.

In the fourth group of pulp aerators 17 secured at the top of the vessel 5 for collecting gangue, the number of aerators 17 is four. Axes of the tubular casings of the aerators 17 of this group extend perpendicularly to the axis 0 of the pulp circulation chamber 1.

Secured to the frame 4 outside the tapered bottom 2 is an annular tubular header 18 for feeding liquid to the pulp aerators 17 communicating through a vertical pipe 19 with a source (not shown) of the liquid under a pressure of 2 to 2.5 atm. Nozzles 20 equal in number to the number of the pulp aerators 17 are provided at the tubular header 18, one end of a flexible hose 21 being connected to each such nozzle 20, the other end of the hose 21 being connected to the tubular casing of one of the pulp aerators 17. Also provided at the bottom part of the pipe 19 is a safety shut-off valve 22 for feeding compressed air to the pulp aerators, this header 23 communicating via the pipe 24 with a source (not shown) of compressed air. The pressure of compressed air in the header 23 is 0.1-0.2 atm lower than the pressure of liquid in the header 18. A shut-off valve 25 is mounted at the pipe 24 to control the pressure of compressed air. Nozzles 26 equal in number to the number of pulp aerators 17 are provided at the tubular header 23 for feeding compressed air, one end of a flexible hose 27 being connected to each nozzle 26, the other end of the flexible hose 27 being connected to the tubular casing of one of the pulp aerators 17.

The pipe 7 for feeding the flotation pulp carrying mineral particles of fine fraction is connected to a pipe 28 for feeding the flotation pulp which is in turn connected to a pipe 29 intended to feed the aerated liquid and has a means 30 for aerating the liquid. The liquid aerating means 30 has nipples 31 and 32 to feed compressed air and liquid under pressure, respectively. A discharge pipe 33 is mounted in the pipe 7 for feeding the flotation pulp to clean this pipe 7.

Arrows in FIG. 1 indicate the flow paths of the flotation pulp and aerated liquid.

The proposed flotation machine also includes a means 34 to feed mineral particles of coarse fraction capable of floating in the froth layer of the pulp. The size of particles of the useful ingredient of the mineral held by the froth layer of the pulp is at least two times the size of particles of the useful ingredient of the mineral capable of floating up to the froth layer from the body of the aerated pulp. For a diamond-containing mineral, the size of mineral solids of coarse fraction is 0.8 to 2 mm. For other minerals the size of solid particles of coarse fraction is proportional to the density of the particles of the useful ingredient for these types of mineral being beneficiated.

The means 34 for feeding mineral solids of coarse fraction includes a cylindrical casing 35 positioned in line with the axis 0 of the chamber 1 and secured to a frame 36, which is rigidly secured on the shell of the trough 8 for collecting froth concentrate. Provided at the top of the casing 35 is a funnel 37 for charging mineral solids of the coarse fraction.

The means 34 for feeding mineral particles of the coarse fraction further includes a receiver 38 having a casing in the form of a truncated cone extending in line with the axis 0 of the chamber 1 to face a base 39 having the form of a disk positioned at the level of the upper edge of the chamber 1, this receiver 38 being positioned with a slotted clearance 40 relative to the base 39 for compressed air to escape therethrough. The casing of the receiver 38 is mounted on radial ribs 41 which bear on the base 39 secured at the tapered baffle element 16.

The top part of the casing of the receiver 38 communicates via a hollow shaft 42 with a pipe 43 for feeding compressed air. Positioned immediately over the casing of the receiver 38 is a tapered plate 44 with a substantially flat ring 45 secured at its periphery, the plate 44 being mounted on the hollow shaft 42, journalled in bearings 46 to be capable of rotation, and connected through tapered toothed wheels 47, 48 and reduction gear 49 to an electric motor 50. The reduction gear 49 and electric motor 50 are mounted on a frame 36.

Figure 4:
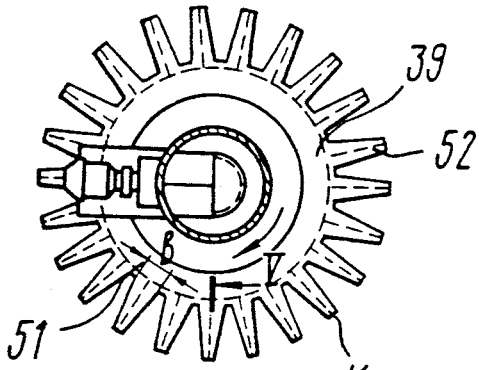
FIG. 4 is a section taken along line IV—IV in FIG. 1.

In order to ensure a more uniform distribution of mineral solids of coarse fraction at the surface of the froth layer of pulp, there is provided a distribution ring 51 secured between the means 34 for feeding mineral particles of the coarse fraction and upper tapered shell 11 coaxially with the tapered shells 10, 11. The priphery of the distribution ring 51 has the form of radially extending teeth 52 (FIG. 4) with the image of their top points K, if projected onto a horizontal plane, disposed between the projections of the bases of larger diameter of the upper tapered shells 10 and 11 (FIG. 1) onto the same horizontal plane. The distribution ring 51 is made of a wear resistant material, such as polyurethane, arranged coaxially with the base 39 (FIG. 4), and rigidly connected therewith. It can also be made integral with the base 39.

The number of teeth 52 in the distribution ring 51 depends on the diameter of the upper tapered shell 10, and normally the base of each tooth 52 has a width "b" of 25 to 35 mm.

Figure 6:
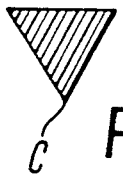
FIG. 6 is a section taken along line VI—VI in FIG. 5.
Figure 5:
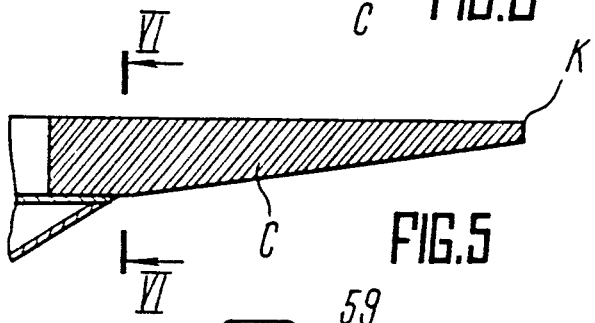
FIG. 5 is a section taken along line V—V in FIG. 4.

In a longitudinal section each tooth 52 (FIG. 5) is trapezoidal and faces by its inclined edge C toward the upper shells 10 (FIG. 1) and 11. In a cross section each tooth 52 (FIG. 6) has the form of an isosceles triangle with the vertex C thereof facing the upper tapered shells 10, 11 (FIG. 1).

Provision of the distribution ring 51 with teeth 52 (FIG. 4) ensures uniform distribution of mineral particles of coarse fraction at the surface of the froth layer and slowing their velocity, which reduces the likelihood of mineral particles escaping from the pulp froth layer.

In the proposed flotation machine for beneficiating minerals use is made of pulp aerators 17 so constructed as to generate a directional flow of aerated liquid with uniformly distributed monodispersed air bubbles in this flow. The size of air bubbles is normally 10 to 50 mkm.

Figure 7:
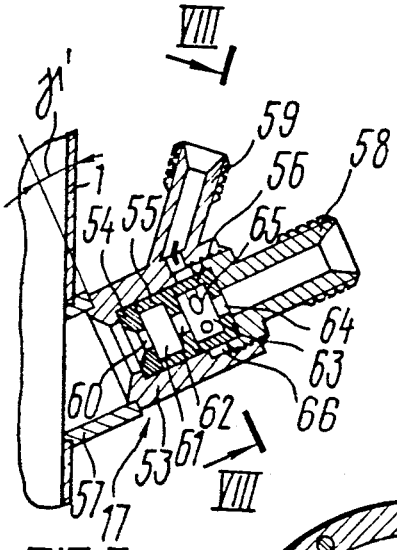
FIG. 7 is an enlarged longitudinal sectional view of section C in FIG. 1.

Referring now to FIG. 7, secured in succession inside a tubular casing 53 of each pulp aerator 17 are three inserts 54, 55, 56 fabricated, for example, from a wear resistant material, such as polyurethane.

One end of the tubular casing 53 is connected to a sleeve 57 secured at the cylindrical pulp circulation chamber 1. One end of the sleeve 57 at the side of the tubular casing 53 of the aerator 17 is perpendicular to its axis, whereas the other end facing the chamber 1 is at an angle $\gamma$ to the generating line of the cylindrical surface of the chamber 1 to preset the required inclination angle of the tubular casing 53 of the aerator 17 to the axis of the chamber 1.

Provided at the other end of the tubular casing 53 is a nipple 58 for feeding the liquid. A nipple 59 for feeding compressed air is secured at the side surface of the tubular casing 53 of the pulp aerator 17 and positioned at an acute angle to its axis.

The insert 54 has an axial hole 60 in the form of a nozzle wherethrough the flow of aerated liquid escapes. The insert 55 has an axial hole 61 to induce acoustic vibrations in the aerated liquid necessary for obtaining monodispersed air bubbles, and an axial hole 62.

The insert 56 has a hole 63 serving to induce acoustic vibrations in the aerated liquid necessary for obtaining monodispersed air bubbles, and an axial hole 64 communicating with the nipple 58 for feeding the liquid.

Figure 8:
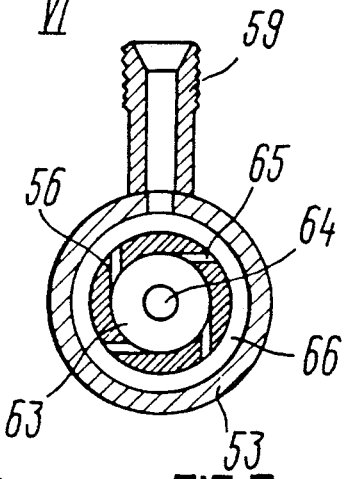
FIG. 8 is a section taken along line VIII—VIII in FIG. 7.

The insert 56 also has four tangential holes 65 communicating the hole 64 (FIG. 8) via an annular groove 66 made in the tubular casing 53 with the compressed air nipple 59. The tangential holes 65 act to swirl compressed air as it is mixed with the liquid to ensure uniform distribution of air bubbles in the flow of aerated liquid.

Figure 9:
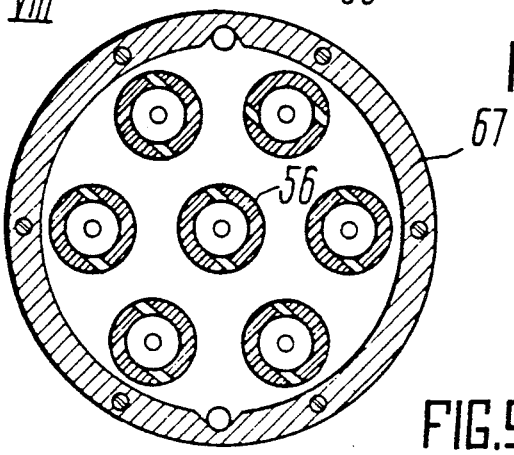
FIG. 9 is a section taken along line IX—IX in FIG. 1.

In the herein described embodiment of the flotation machine, the liquid aerating means 30 (FIG. 1) secured in the pipe 29 for feeding the aerated liquid includes a tubular casing 67 (FIG. 9) accommodating seven inserts 56 the axes of which are spaced uniformingly across the tubular casing 67 to ensure uniform distribution of air bubbles in the flow of aerated liquid of substantial cross section.

The proposed flotation machine for beneficiating minerals operates in the following manner.

Preliminarily, the cylindrical chamber 1 (FIG. 1) for circulating the flotation pulp is filled with water and a froth generating agent. The water and froth generating agent are conveyed simultaneously via the pipe 7 for feeding the flotation pulp carrying mineral particles of fine fraction and via the pulp aerators 17.

At the same time, compressed air is conveyed through the pipe 24 to the annular header 23, and then through the flexible hoses 27 secured at the nipples 26 to the pulp aerators 17.

The liquid under pressure is fed to the annular header 18 through the vertical pipe 19, and then the liquid flows from the header 18 via nipples 20 and flexible hoses 21 to the pulp aerators 17. As the chamber 1 is filled with water, operation of the aerators 17 is visually monitored by the presence of jets of the aerated liquid escaping from the outlet holes of the tubular casings of the pulp aerators 17. The pulp aerators 17 overlying the level of the pulp present in the chamber 1 produce a characteristic whistling noise.

As the chamber 1 is filled with water containing the froth generating agent and aerated liquid, a stable pulp froth layer is formed at the surface of the liquid phase, whereby upon reaching the upper edge of the chamber 1 it flows over this edge to the trough 8 for collecting froth concentrate.

After this water and froth generating agent are delivered at a flow rate ensuring that the level of the froth layer is close to the level of the upper edge of the chamber 1. As a result, some of the liquid conveyed to the chamber 1 continuously flows out of the pipe 6 for discharging gangue.

Then the flotation pulp containing mineral particles of fine fraction is admitted to the pulp circulation chamber 1 via the pipe 7.

At the same time, conveyed continuously to the casing 35 via the funnel 37 of the means 34 for feeding mineral particles of coarse fraction whose useful ingredient is capable of floating in the froth layer of the flotation pulp are solid particles of this mineral preliminarily treated by flotation reagents present in the flotation pulp.

In the course of operation of the flotation machine, the flotation pulp present in the pulp circulation chamber 1 is continuously saturated with air bubbles fed through the pulp aerators 17 uniformly spaced at the side surface of the chamber 1 by jets of the aerated liquid, and through the pulp aeration means 30 by the flow of the aerated liquid. The operating principle of the aerators 17 resides in the following. As a liquid under pressure, particularly water and froth generating agent, is fed through the nipple 58 (FIG. 7) by a jet of liquid passing through the axial holes 64, 63, 62, 61, air is ejected to flow through the nipple 59, annular groove 66 and tangential holes 65 (FIG. 8) to the hole 63 for mixing the liquid and air. As the liquid is mixed with air, an aerated jet with uniformly dispersed air bubbles is formed. Formation of the aerated jet of liquid is facilitated by that the compressed air is accelerated in the tubular casing 53 thanks to that it is fed tangentially to the hole 63 of the insert 56 for mixing the liquid and air. The vectors of velocities of the liquid and air are different.

As the mixture of water and air is conveyed through the hole 61 (FIG. 7) of the insert 55 and acoustic vibrations are generated in the jet of aerated liquid, drops of water of substantially equal size are formed. The thus formed jet of aerated liquid escapes from the axial hole 60 of the insert 54 funcitioning here as a nozzle to initiate in the chamber 1 a flare of aerated liquid, droplets of uniform size of the aerated liquid at the boundary between the flare and flotation pulp eject air bubbles of virtually uniform size. The size of air bubbles ranges from 10 to 50 mkm.

Saturation of the pulp with monodispersed air bubbles of substantially uniform size prevents fusion of the bubbles as they move toward the froth layer of the flotation pulp, which facilitates flotation of the mineral particles of fine fraction from the volume of the aerated pulp and separation of the solid particles of the coarse fraction of the mineral in the layer of froth. The flotation pulp carrying mineral particles of fine fraction whose useful ingredient is capable to float up from the body of the aerated pulp is conveyed through the pipe 28 (FIG. 1), and after being mixed with the aerated liquid conveyed from the liquid aerating means 30 is directed via the pulp feeding pipe 7 to the cylindrical chamber 1, particularly to the zone confined by the tapered shells 10. This is accompanied by fusion of the air bubbles carrying solid particles of the useful ingredient of the mineral. The flow of aerated pulp escaping from the pulp feeding pipe 7 moves upward of the axis 0 of the cylindrical chamber 1 entraining mineral solids of fine fraction of the useful ingredient. In the course of its upward movement in the chamber 1, the flow of aerated pulp expands, and its velocity is reduced. At the same time, the flow becomes less turbulent thanks to the provision of ribs 15 at the top part of the chamber 1. Reduced turbulence of the flow facilitates flotation of the solid particles of the useful ingredient, especially those of the upper size range. Also, reduced turbulence of the flow is facilitated by an increase in the size of air bubbles by virtue of the fusion of finer air bubbles at the surface of the solid particles of the useful ingredient as a result of using flotation reagents. Of substantial importance are oily reagents.

The flow of aerated liquid ascending in line with the axis 0 of the chamber 1 is enriched at the top layers with air bubbles floating up from the body of the aerated pulp to change the travel path toward the trough 8 for collecting froth concentrate by the tapered baffle element 16. The froth formed at the surface of the aerated pulp moves in the same direction and overflows by gravity to the trough 8 for collecting the froth concentrate.

As the flow of aerated pulp moves upwards, each tapered shell 10 acts to cut thin layers of the pulp off the outer surface of the flow and force these layers to a zone outside the tapered shells 10. Such cutting of thin layers of the pulp with all the ingredients present therein is ensured thanks to that the angle $\alpha$ (FIG. 2) of inclination of the generating line of the tapered surface of each tapered shell 10 to its axis of rotation is greater than the angle $\beta$ of inclination of the generating line of the tapered surface P. In this case the tapered shells 10 function as concentric blades to shave layer-by-layer the pulp at the outer periphery of the flow moving inside the tapered shells 10, thereby ensuring uniform distribution of the pulp inside the chamber 1 and changing the turbulent movement of the pulp to a laminar essential for floating solid particles up from the body of the aerated pulp, which is very important for floating solid particles of the useful ingredient of a size approaching the upper limit of coarseness. Also, this ensures flotation of even larger solids of the useful ingredient of the mineral from the body of the aerated pulp.

As the pulp flows inside the tapered shells 10, and as the layers of pulp escape from the clearances "a" between the shells 10 away from the shells 10, solid particles of the useful ingredient of the mineral are floated in a flow of aerated pulp where the vectors of movement of solids and air bubbles coincide. Outside the tapered shells 10 the travel path of the solid particles of the mineral changes, and the particles tend to settle down. Flotation of solid particles of the mineral takes place in a countercurrent, i.e., when air bubbles and mineral solids move in the opposite directions. Such flotation conditions are not efficient for large-size mineral solids, because mostly mineral solids of the small size range are floated.

While settling down, the mineral solids fall on the tapered shells 12 (FIG. 1) neighbouring the tapered bottom 2 of the chamber 1 to be move therealong by jets of aerated liquid escaping from the pulp aerators 17 at the top and bottom of the shells 12 toward the vessel 5 for collecting gangue. Moving from the overlying tapered shells to the underlying shells 12, the mineral solids cross the clearances therebetween from which the flow of aerated liquid escaping from the pulp aerators 17 positioned at the lower level of the cylindrical portion of the chamber 1 is conveyed to the chamber 1. This is accompanied by flotation of the remaining particles of the useful ingredient of the mineral. The same occurs when mineral solids descend to the gangue collecting vessel 5 where the solid particles of the useful ingredient of the mineral cross the flows of aerated liquid leaving the pulp aerators 17 at the top section of this vessel 5. Therewith, solid particles of the gangue are continuously evacuated from the vessel 5 via the pipe 6 for discharging the gangue.

Larger and heavier particles are evacuated from the flotation machine through the pipe 33. Simultaneously with feeding via the pipe 28 of the flotation pulp carrying mineral solids of fine fractions whose useful ingredient is capable of floating up from the body of the aerated pulp, mineral solids of coarse fraction whose particles of the useful ingredient are capable of reliably resting in the froth layer are conveyed to the means 34. With this aim in view, the plate 44 journalled in bearings 46 is preliminarily rotated by the electric motor 50 through the reducing gear 49 and bevel gear-wheels 47 and 48. At the same time, compressed air is admitted through the pipe 43 and hollow shaft 42 to the receiver 38 wherefrom it escapes through the slotted clearance 40.

From the casing 35 solid mineral particles of coarse fraction are conveyed to the rotating plate 44 to spread uniformly on its tapered surface, and to fall therefrom onto the distribution ring 51, where a flow of froth saturated with air bubbles is formed between the teeth 52 (FIG. 4) thereof directed toward the trough 8 (FIG. 1) for collecting froth concentrate. Delivered onto the flow of froth in dispersed state are mineral solids of coarse fraction entrained by a substantially flat flow of compressed air escaping from the slotted clearance 40 of the receiver 38 toward the trough 8 for collecting froth concentrate.

Solid particles of the useful ingredients of the mineral floated up from the body of the pulp and mineral particles of the useful ingredient of the coarse fraction of this mineral retained by the layer of froth are carried by the froth to the trough 8, and evacuated from the flotation machine via the pipes 9 for discharging the froth concentrate.

Solid particles of the useful ingredient of the mineral thrown out, for example, as a result of collision, from the froth layer in the course of its movement toward the froth concentrate trough 8 enter the clearance between the tapered shells 10 and 11.

While settling on the inner surface of the tapered shells 11 and moving therealong under the force of gravity, mineral solids separated from the froth layer are entrained by the counter flow of the aerated pulp moving into the clearances $a_1$ (FIG. 3) between the tapered shells 11. Vigorous flow of aerated pulp in the clearances $a_1$ is produced thanks to that the ascending air bubbles flow about the outer surfaces of the tapered shells 11 to result in accumulation of air bubbles in the clearances $a_1$ between the tapered shells 11 and a tendency of the solid particles of the useful ingredients of the mineral to adhere to the air bubbles in the clearances $a_1$ between the tapered shells 11, whereby such solid particles of the useful ingredient of the mineral return to the froth layer. Therewith, solid particles of gangue descend to the bottom of the chamber 1 (FIG. 1) to be discharged subsequently. A more pronounced flotation effect in the zone of tapered shells 11 is promoted by the group of pulp aerators 17 positioned at the upper level of the chamber 1 immediately under the lower tapered shell 11 with the axis of their tubular casings disposed perpendicularly to the axis of the chamber 1. Other groups of pulp aerators 17 are engaged in this process only partially, since their basic function is to saturate the pulp with air bubbles in the entire volume of the chamber 1.

In view of the aforedescribed, the tapered shells 11 make it possible to return large-size particles of the useful ingredient of the mineral, and to substantially increase the yield of the useful ingredient from the mineral subjected to beneficiation in the proposed flotation machine.

What is claimed is:

1. A flotation machine for beneficiating minerals comprising:

a vertically oriented cylindrical chamber for circulating a flotation pulp;

a downwardly tapered bottom connected to said cylindrical chamber;

feed pipe means extending into the downwardly tapered bottom and oriented to open upwardly toward said cylindrical chamber for feeding the flotation pulp containing mineral particles of fine fraction with particles of the useful ingredient of the mineral capable of floating up from the body of said flotation pulp;

discharge pipe means connected to the downwardly tapered bottom near the bottom's lowest point for discharging gangue;

trough means secured at the top part of the cylindrical chamber for collecting a froth concentrate;

a first group of hollow truncated cones positioned axially within said cylindrical chamber and having an upper base and a lower base wherein the diameter of the upper base is larger than the diameter of the lower base and a side tapering downwardly and inwardly from the upper base to the lower base defining a first angle of inclination with respect to the longitudinal axis of said first group of cones, each of said cones spaced at equal distances from each other and having substantially the same height, wherein the upper bases of the cones face the top part of said cylindrical chamber in a manner such that a plane passing through an edge of each upper base forms a second angle of inclination with respect to the longitudinal axis of the first group of cones and wherein the second angle of inclination is less than the first angle of inclination; and a seocond group of hollow truncated cones positioned axially at the top part of said cylindrical chamber and lying outside of said first group of cones and having an upper base and a lower base wherein the diameter of the upper base is larger than the diameter of the lower base and a side tapering downwardly and inwardly from the upper to the lower base defining a third angle of inclination with respect to the longitudinal axis of said second group of cones, said second group of cones spaced at equal distances from each other and having substantially the same height, wherein the lower bases of said second group of cones face said tapered bottom in a manner such that a plane passing through the edge of each lower base forms a fourth angle of inclination with respect to the longitudinal axis of the second group of cones and wherein the fourth angle of inclination is greater than the third angle of inclination;

pulp aerator means secured to the walls of said cylindrical chamber for supplying a gas to the flotation pulp; and means positioned over the cylindrical chamber for feeding mineral particles of coarse fraction containing particles capable of staying in the froth layer of pulp to the cylindrical chamber.

2. The flotation machine of claim 1 wherein the pulp aerator means comprises a plurality of tubular aerators spaced equidistantly around the cylindrical chamber.

3. The flotation machine of claim 1 comprising distribution ring means positioned between said means for feeding mineral particles and the upper cone of the second group of truncated cones and being coaxial with said truncated cones of said first and second groups of truncated cones.

4. The flotation machine of claim 3 wherein the distribution ring means has a peripheral portion comprising radially extending teeth each having an upper edge such that if said edges are projected on a horizontal plane, a projection of the upper bases of the upper cones of said first and second truncated cones in the same plane are disposed between the projection of said edges.

5. The flotation machine of claim 1 comprising:

first nipple means secured to the tubular casing and positioned along the longitudinal axis of said tubular casing for providing a pathway for the flow of a liquid;

second nipple means secured to the tubular casing and positioned at an angle with respect to the longitudinal axis of said tubular casing for feeding compressed air to said liquid to thereby form an aerated liquid;

first, second and third inserts arranged in succession in said tubular casing of each of said pulp aerators, said third insert being positioned at the side of said first nipple means;

a first group of holes in the first, second and third inserts for generating acoustic vibrations in said aerated liquid;

an annular groove in said tubular casing; and a second group of holes arranged tangentially about the third insert and communicating with said first group of holes through the annular groove for uniformly distributing the compressed air in the liquid.

6. A flotation machine for beneficiating minerals comprising:

a vertically oriented cylindrical chamber for circulating a flotation pulp;

a downwardly tapered bottom connected to said cylindrical chamber;

feed pipe means extending into the downwardly tapered bottom and oriented to open upwardly toward said cylindrical chamber for feeding the flotation pulp containing mineral particles of fine fraction with particles of the useful ingredient of the mineral capable of floating up from the body of said flotation pulp discharge pipe means connected to the downwardly tapered bottom near the bottom's lowest point for discharging gangue;

trough means secured at the top part of the cylindrical chamber for collecting the froth concentrate; a first group of hollow truncated cones positioned axially within said cylindrical chamber and having an upper base and a lower base wherein the diameter of the upper base is larger than the diameter of the lower base and a side tapering downwardly and inwardly from the upper base to the lower base defining a first angle of inclination with respect to the longitudinal axis of said first group of cones, each of said cones spaced at equal distances from each other and having substantially the same height, wherein the upper bases of the cones face the top of part of said cylindrical chamber in a manner such that a plane passing through an edge of each upper base forms a second angle of inclination with respect to the longitudinal axis of the first group of cones and wherein the second angle of inclination is less than the first angle of inclination; a second group of hollow truncated cones positioned axially at the top part of said cylindrical chamber outside of said first group of cones and having an upper base and a lower base wherein the diameter of the upper base is larger than the diameter of the lower base and a side tapering downwardly and inwardly from the upper base to the lower base defining a third angle of inclination with respect to the longitudinal axis of said second group of cones, each of said second group of cones spaced at equal distances from each other and having substantially the same height, wherein the lower bases of said second group of cones face said tapered bottom in a manner such that a plane passing through the edge of each lower base forms a fourth angle of inclination with respect to the longitudinal axis of the second group of cones and wherein the fourth angle of inclination is greater than the third angle of inclination;

means positioned over the cylindrical chamber for feeding mineral particles of coarse fraction containing particles capable of staying in the froth layer of pulp to the cylindrical chamber;

an even number of a first group of pulp aerators each comprising a tubular casing secured to the walls of said cylindrical chamber and spaced equidistant and resting substantially in the same plane within the cylindrical chamber, said tubular casings of said first group of pulp aerators having an axis extending substantially perpendicular to the longitudinal axis of said cylindrical chamber and resting in the same plane immediately under the lower cone of said second group of truncated cones; and an even number of a second group of pulp aerators each comprising a tubular housing secured to the walls of said cylindrical chamber and spaced equidistant and resting below a plane passing through the axes of said tubular casings of the first group of pulp aerators, wherein the tubular casings of said second group of pulp aerators are directed towards said tapered bottom and each have an axis which extends at an acute angle to the longitudinal axis of said cylindrical chamber and directed toward said tapered bottom.

7. The flotation machine of claim 6 further comprising:

distribution ring means positioned between said means for feeding mineral particles and the upper cone of the second group of truncated cones and being coaxial with said truncated cones of said first and second groups of truncated cones, wherein the distribution ring means has a peripheral portion comprising radially extending teeth each having an upper edge, such that if said edges are projected on a horizontal plane, a projection of the upper bases of the upper cones of said first and second groups of truncated cones in the same plane are disposed between the projection of said edges.

8. The flotation machine of claim 6, further comprising:

first nipple means secured to the tubular casing and positioned along the longitudinal axis of said tubular casing for providing a pathway for the flow of the liquid;

second nipple means secured to the tubular casing and positioned at an angle with respect to the longitudinal axis of said tubular casing for feeding compressed air to said liquid to thereby form an aerated liquid;

first, second and third insert arranged in succession in said tubular casing of each of said pulp aerators, said third insert being positioned at the side of said first nipple means;

a first group of holes in the first, second and third inserts for generating acoustic vibrations in said aerated liquid;

an annular groove in said tubular casing; and a second group of holes arranged tangentially about the third insert and communicating with said first group of holes through the annular groove for uniformly distributing the compressed air in the liquid.

* * * * *